United States Patent [19]

Zapffe

[11] 4,383,853

[45] May 17, 1983

[54] CORROSION-RESISTANT FE-CR-URANIUM$^{238}$ PELLET AND METHOD FOR MAKING THE SAME

[75] Inventor: Carl A. Zapffe, 6410 Murray Hill Rd., Baltimore, Md. 21212

[73] Assignees: William J. McCollough; Carl Zapffe, both of Brainerd, Minn.

[21] Appl. No.: 235,574

[22] Filed: Feb. 18, 1981

[51] Int. Cl.$^3$ ..... C22C 1/04; C22C 33/00; C22C 43/00; F42B 11/14

[52] U.S. Cl. ..... 75/122.7; 75/0.5 C; 75/123 H; 75/126 G; 102/448; 448/501

[58] Field of Search ..... 75/122.7, 123 H, 126 G, 75/0.5 C; 102/448; 241/184; 148/3

[56] References Cited

U.S. PATENT DOCUMENTS

| | | | |
|---|---|---|---|
| 3,203,788 | 8/1965 | Contractor et al. | 75/123 H |
| 3,302,570 | 2/1967 | Marquardt et al. | 102/519 |
| 3,370,535 | 2/1968 | Permutter | 102/518 |
| 3,420,660 | 1/1969 | Kawahata et al. | 75/171 X |
| 3,981,722 | 9/1976 | Ray et al. | 75/122.7 |
| 4,221,587 | 9/1980 | Ray | 75/0.5 C |

FOREIGN PATENT DOCUMENTS

| | | | |
|---|---|---|---|
| 656633 | 12/1964 | Belgium | 75/0.5 C |

OTHER PUBLICATIONS

Giessen, B. C. et al., International Conference on Rapidly Quenched Metals, 3rd, Univ. of Sussex, England, 1978, Properties of Metallic Glasses Containing Actinide Metals: I. Thermal Properties of U-M Glasses (M=V, Cr, Mn, Fe, Co, and Ni), pp. 406∝411.

Ray, Rantan, *Metal Progress*, Jun. 1982, pp. 29-31, (American Society for Metals), "Bulk Microcrystalline Alloys from Metallic Glasses".

Loewenstein, Paul, *Metals Handbook*, vol. 3, 9th Edition, 1980, pp. 773-780 (American Society for Metals), "Industrial Uses of Depleted Uranium".

Beahm, E. C. et al., "Laves Phases of Uranium and 3d Transition Metals", Journal of the Less Common Metals, 50:57-71 (1976).

Grogan, J. D., "The Uranium-Iron System", Journ. of the Institute of Metals (London) 77:571-580 (1950).

Olofson et al., "Final Report on Processing and Applications of Depleted Uranium Alloy Products", to M.C.I.C., Aug. 6, 1976.

*Primary Examiner*—Helen M. McCarthy

*Attorney, Agent, or Firm*—Connolly and Hutz

[57] ABSTRACT

High density, generally microscopically homogeneous corrosion-resistant chromium-uranium metal alloys for ammunition use (particularly for spherical pellets or shot) can be made from $U^{238}$ or an isotopic mixture high in $U^{238}$ (such as "depleted uranium") and at least about 10 atomic % chromium. The alloys can also contain one or more metals of Group VIII, first triad, of the Periodic Table, and a variety of other elements used, for example, in making ferrous metals. Major factors to be considered in formulating the alloy are density, melting point or melting range, passivity or chemical or biological inertness, resistance to segregation in the molten phase and upon rapid cooling (chromium-poor phases or regions being particularly undesirable), and compensation for any loss of free chromium due to formation of intermetallic or other forms of combined chromium. The uranium content in the alloy is preferably less than 70 atomic %. Rapid cooling of the chromium-uranium or chromium-uranium-Group VIII metal melt, e.g. by the shot tower technique, avoids undesirable segregation effects which can detract from corrosion resistance. The shot tower may optionally contain a non-oxidizing atmosphere.

15 Claims, No Drawings

CORROSION-RESISTANT FE-CR-URANIUM$^{238}$ PELLET AND METHOD FOR MAKING THE SAME

TECHNICAL FIELD

This invention relates broadly to uranium metal alloys and their use in ammunition, e.g. pellets of the shot or generally spherical type. An aspect of this invention relates to a method for making ammunition (e.g. spherical pellets) wherein a molten chromium-uranium mixture is cooled rapidly, e.g. by exposing drops of the molten mixture to normal ambient temperature conditions. Still another aspect of this invention relates to a chromium-uranium 238 alloy which is sufficiently corrosion resistant to be used in the manufacture of high-density shotgun pellets. Still another aspect of this invention relates to a solid chromium-uranium alloy, pellets made from this alloy, and methods for making the pellets, wherein the uranium metal contains at least as much of the $U^{238}$ isotope as naturally-occurring uranium and preferably contains less than about 0.3% of the $U^{235}$ isotope.

DESCRIPTION OF THE PRIOR ART

Metallic lead has been used in ammunition since the earliest days of ordnance technology. Lead is plentiful, inexpensive, easily fused and formed, and very dense—the typical reported density value being 11.34 g/cm$^3$. All of these advantages have been important in the manufacture of ammunition pellets, particularly spherical pellets of the type used in shotgun shells. The typical shotgun shell comprises a cylindrical casing enclosing an explosive charge and a plurality of spherical pellets. The density of the pellets is particularly important to sportsmen such as hunters and trapshooters. The high density of lead has been a popular feature of lead shot among sportsmen, many of whom prefer lead over other metals and alloys having a density less than about 8.0 g/cm$^3$.

Lead shot has, however, one overwhelming disadvantage. Toxic effects of lead upon the systems of live waterfowl, whether remnant from nonlethal injury or perhaps ingested with wild grains during feeding, have prompted protective action on the part of Governmental agencies concerned with environmental quality. These agencies have urged or even forced restrictions on the use of lead shot in shotgun shells used by outdoor sportsmen.

Those branches of the ordnance or ammunition industries concerned with supplying sportsmen have responded to this toxicity problem by substituting various other metal pellets for lead pellets. The substitutes for lead are metals or alloys which are generally considered to be less toxic, foremost among these metals or alloys being stainless steel. Stainless steel is a more likely substitute than, for example, nickel, since it is relatively inexpensive. Furthermore, the high industrial and military priority attached to many of the denser metals such as nickel makes their continuous availability for purely outdoor sports usage questionable. The primary advantage of such metals is their specific gravity (8.90 in the case of nickel), which is far below lead but still significantly above the 7–8 range typical of most ferrous metals (particularly the steels). Iron and steel have other disadvantages besides low density. The melting point of iron is 1,535° C.—more than eighty Celsius degrees above the melting point of nickel. Lead melts at only 327° C. Maintaining iron in a molten condition unquestionably involves large amounts of energy and makes formation of spherical shot by the drop technique more difficult.

At the present time, the alloying of iron or steel with lead does not appear to be a practical alternative for the manufacture of spherical pellets. Iron and steel do not appear to have sufficient compatibility with lead, even in the molten state, and the formation of a spherical shot from a metal containing segregated lead or iron or lead- or iron-rich phases is not an attractive prospect.

There are, of course, many other metals which do dissolve in molten iron or steel. Many of these metals have a specific gravity below 8.0 (i.e. a density below 8.0 g/cm$^3$) and thus do little to improve the ballistic properties of stainless steel shot. Other metals, such as wolfram (tungsten) have a density even higher than lead but also have very high melting points—3,380° C. in the case of wolfram. In addition, wolfram is too expensive to be competitive with nickel and other lower-melting metals having a higher density than iron.

Uranium is a very dense metal, which is now becoming readily available as an isotopic mixture containing more than the naturally-occurring amount of $U^{238}$. The most plentiful type of high-percent $U^{238}$ is a by-product of the uranium enrichment process for nuclear power. This by-product uranium metal is called "depleted uranium". Natural uranium normally contains 99.3% of $U^{238}$, 0.7% of $U^{235}$, and 0.005% of $U^{234}$. (These percentages are approximately the same on either an atomic or weight-percent basis, due to the very small differences between these isotopes in their atomic weights and densities.) The uranium enrichment process produces two products: uranium "enriched" in $U^{235}$ and the so-called depleted uranium, which typically contains less than 0.3% $U^{235}$. Efforts are now underway to utilize depleted uranium in nonnuclear applications, since its supply is large and growing, and since its radioactivity level is very low (hardly more hazardous than a radium-dial watch). Radiation exposure is thus not a great problem to employees working in the presence of large quantities of depleted uranium or its alloys, and techniques for reducing toxicity hazards are known. For these and other reasons, depleted uranium and its alloys have been suggested for high-density applications, including munitions. U.S. Pat. No. 3,773,569 (Edelman et al.), issued Nov. 20, 1973 describes a uranium-titanium binary alloy containing more than 98% uranium and therefore having a nominal density in excess of 18 g/cm$^3$. It has also been suggested to use sintered uranium in the core of ammunition having a subcalibre shell. See U.S. Pat. No. 3,498,222 (Birkigt), issued Mar. 3, 1970. However, the applicability of these developments to the manufacture of sports ammunition is by no means straightforward. Uranium and its salts are both toxic. In addition, uranium has a high level of chemical activity toward elements and compounds which occur commonly in the environment, e.g. water and oxygen. The coating or encapsulation of uranium within a corrosion-resistant material would appear to be impractical from an industrial standpoint; furthermore, the grinding action of the digestive system of waterfowl would expose the enclosed uranium core to the animal's system.

SUMMARY OF THE INVENTION

It has now been found that uranium (e.g. "depleted uranium" with its low radioactivity and higher-than-normal content of $U^{238}$) can be used successfully in ammunition, particularly spherical pellets, by alloying the uranium with a suitable amount of chromium and, if desired, a metal of the first triad of Group VIII of the Periodic Table. Although uranium alloys have been known at least since 1914 (e.g. ferro-uranium alloys), certain unusual characteristics of the preferred uranium alloy systems must be taken into account when making ammunition with the desired characteristics. Uranium undergoes two phase changes as it is heated up from the solid state. From room temperature up to 660° C., the metal is in the so-called alpha state or phase. Beta-phase uranium is the allotropic form in the 670°–780° C. range. Still another phase change converts the metal to the gamma phase at above 780° C. Only the gamma phase (between 780° C. and the melting point, approximately 1,132° C.) has a body-centered cubic crystalline structure similar to a structure of iron. If ferro-chromo-uranium alloys were cooled slowly, the uranium would have a tendency to segregate, leading to the formation of microscopic regions of significantly altered composition as compared to the overall composition of the alloy. Such segregation, which may be undesirable in the context of this invention, can be mitigated by rapid cooling of the uranium alloy from the molten state. Fortunately, such rapid cooling can be easily achieved with a conventional shot tower, where drops of the molten alloy are formed and permitted to fall through an atmosphere or medium which is substantially at normal ambient temperatures. The rapidly cooled solid and generally spherical pellets have a greater tendency to comprise alloys of generally uniform composition, both microscopically and macroscopically, as compared to melts or liquid-solid mixtures cooled more slowly. To provide an alloy which is corrosion resistant and essentially inert toward the environment and the interior biological systems of animals and birds, it is particularly preferred that the uranium be alloyed with an amount of chromium sufficient to be corrosion resistant under a variety of conditions. Although this invention is not bound by any theory, it is believed that an important principle of stainless steel technology applies to uranium-chromium alloys; namely, that an alloy (whether or not it contains iron) may have the property of forming a microscopic layer of protective oxide (similar to the alumina layer on aluminum metal exposed to air) provided that the chromium content of the alloy is at least about 10 atomic percent, more preferably at least about 12 atomic percent. In other words, at least one out of every 10 (more preferably one out of every 8) atoms in the alloy should be chromium to obtain "stainless" properties. Other desiderata which normally play a predominant role in metallurgy (e.g. cold-working and stress-induced corrosion properties of the alloy) are of minor significance in the context of this invention, wherein the major factors to be considered are density, melting point or melting range, passivity or chemical/-biological inertness, resistance to segregation in the molten phase and upon rapid cooling, and compensation for any loss of free chromium from formation of intermetallic compounds and other combined forms of chromium.

Accordingly, this invention contemplates a solid, generally spherical, generally corrosion-resistant metal pellet comprising a relatively non-segregating corrosion-resistant chromium-uranium alloy which has been cooled from the molten state to below its solidification temperature (e.g. to below about 670° C.) quickly enough to prevent the formation of a segregated uranium-rich phase wherein the atomic percent of chromium in the phase is less than about 10%, the resulting alloy having a specific gravity of at least about 8.4. It is desirable to avoid formation of any phase whose altered chromium might adversely detract from the passivated character of the alloy. The invention also contemplates a solid chromium-uranium 238 alloy comprising at least about 10 weight-% or about 3 atomic % solid uranium distributed uniformly (microscopically as well as macroscopically) through a corrosion-resistant chromium or ferro-chromium matrix, which alloy has so-called "stainless" characteristics. The melting point of such chromium-uranium alloys is below the melting point of chromium (1905° C.), typical alloys of this invention melting at a lower temperature than iron, i.e. below 1535° C.

DETAILED DESCRIPTION

As will be apparent from the foregoing Summary, alloys of this invention and pellets or other ammunition made from these alloys can be considered to be chromium-uranium alloys because at least about 10 or 11 atom-% of chromium is needed for corrosion resistance and at least about 3 atom-% uranium is needed to make a significant contribution to the density and solidification point depression of the alloy. Theoretically up to 90 atom-% of the alloy can be "depleted uranium" (uranium substantially free of U-235) without losing some corrosion-resistant character; however, there is then a risk that the necessary free chromium may become partially tied up in uranium-chromium intermetallic compounds. Other elements can be included in the alloy to reduce cost, depress the melting point, form intermetallic compounds with uranium, etc., but the density of uranium (almost 19 g/cm$^3$) and the "stainless"-imparting properties of, say, 12–20 atom-% chromium are difficult to improve upon. Aluminum, manganese, and molybdenum can enhance corrosion-resistance in some alloys (aluminum helps the corrosion-resistance of iron by aiding in the formation of thin, adherent metal oxides), but aluminum is low in density—its principal drawback. Metals such as molybdenum, tantalum, and niobium could be useful but for their cost, which is prohibitive in the context of spherical shot manufacture. Of the nonmetallic elements, nitrogen is perhaps a consideration, and silicon and carbon can be present. It is difficult to totally eliminate carbon from a ferro-chromium-uranium alloy, and such elimination is ordinarily not necessary. Conventional steelmaking techniques can reduce carbon levels well below 1 weight-%, e.g. to less than 0.05 weight-%, if desired.

It is ordinarily impractical to include more than about 30 or 35 weight-% of chromium in alloys of this invention. Because of the high atomic weight of uranium, this level of chromium works out to be roughly 85 or 90 atomic percent. Needless to say, much lower atom-% levels of chromium will ensure a high level of free (uncombined) chromium in the microscopic structure of the alloy. It is a fortunate circumstance that uranium happens to form alloys rather easily with chromium, thus underscoring further the usefulness of this metal as a corrosion resistance-imparting element of the alloy composition, just as in stainless steel technology.

Because of the high cost and periodic scarcity of chromium metal, it is desirable to introduce chromium into alloys of this invention in forms other than high-purity chromium metal, e.g. as stainless steel scrap or as chromium ores or compounds (such as chromite) which have been reduced with aluminum, carbon, or other reducing agents. The ferrochrome which is obtained in the carbon reduction process is typically contaminated with a significant amount of carbon, but conventional oxidation treatments can reduce this carbon level if such reduction be necessary or desirable.

Accordingly, alloys of this invention will typically contain a metal or Group VIII, first triad, of the Periodic Table, most preferably iron or mixtures of iron and nickel. Nickel is the most economically practical replacement for iron, but cobalt is technically operative, as are any mixtures of these three Group VIII metals.

An alloy for shot of this invention can comprise as much as about 87 atom-% or about 80 weight-% of iron, nickel, cobalt, or combinations of these Group VIII metals. Ordinarily the amount of Group VIII metal or metallic mixture will be at least one-tenth of the amount of chromium (on a weight basis), more typically at least about twice the weight of the chromium component. For example, it is ordinarily preferable to "dilute" ferrochromium master alloy with further iron, so that the Fe:Cr weight ratio ranges from 1:1 to about 6:1 or even as high as 8:1, depending upon the amount of uranium to be added to form the ferro-chromium-uranium alloy.

Silicon is a very abundant element which is present in many types of steel, though rarely in any amount greater than 1 weight-%, still rarer at 3 or 4% by weight. It is also difficult to avoid the presence of at least some carbon in iron-containing alloys. Amounts of manganese and molybdenum are typically in the range of 0–4 weight-%. Still other elements such as aluminum, copper, vanadium, wolfram (tungsten), zirconium, boron, tantalum, niobium and Group VIII elements such as nickel and cobalt, are ordinarily optional in the context of this invention. They can, in any event, be tolerated if already present in steel scrap used in making an alloy of this invention, the only requirement being that they do not detract from the passive character of the alloy. Nickel, if present, may be used in significant quantities, e.g. up to a one-for-one replacement of the iron.

Many nonmetallic or residual-type elements can be present in alloys of this invention, as in conventional stainless steel. These so-called trace elements can be introduced either through the chromium or ferrochromium component or the depleted uranium. It is ordinarily preferred to keep their amount below about 200 parts per million, although this upper limit is not critical in this invention. Typical of such elements (not previously mentioned in connection with desirable alloys) are oxygen and hydrogen, phosphorus, sulphur, and the like. Nitrogen, selenium, phosphorus, and sulfur may either be present as trace elements or as deliberately added elements. Carbon, even if present in amounts greater than 1 weight-%, can be reduced substantially to trace levels. Alternatively, about 1.0 weight-% Cr can be added for each 0.1 weight-% of carbon in excess of 0.1 weight-%.

Among the ferro-chromium materials used to form the ferro-chromium component of an alloy of this invention are the conventional stainless steels, preferably in the form of stainless steel scrap. Stainless steels commonly contain elements other than iron and chromium, e.g. carbon, manganese, and silicon. The amount of carbon is typically in the range of about 0.01–1% by weight of the stainless steel, but stainless steels containing up to 1.2% by weight carbon are known. The amount of manganese and silicon is typically less than about 2% by weight, and the amount of phosphorus and sulfur typically about 0.4% by weight. The other elements discussed previously are sometimes used in commercially available steels. These elements can be present within the limits described previously. Many of the typical corrosion-resistant steels which contain about 15–30% by weight of chromium contain about 5–19% by weight of nickel.

Although corrosion-resistant or heat-resistant steels containing as little as 4% by weight of chromium are known, which also amounts to roughly 4 atom-% in a typical steel, the stainless steel scrap used in this invention should contain more than 10 atom-% of chromium (e.g. 12–20 atom-%) to ensure that the resulting Fe-Cr-U alloy will contain at least about 10 atom-% of chromium. In those situations wherein the alloying with uranium reduces the chromium fraction to less than 10 atomic percent of the total alloy (including uranium), it is ordinarily preferred that a steel higher in chromium be added also or that some chromium or ferrochromium be added to keep the chromium fraction above 10 atom-%. If desired, further adjustments to the melt can be made by adding other elements discussed previously. Some adjustments in the composition of the melt may have to be made to take into account trace elements present in the depleted uranium or other form of uranium used to make ammunition of this invention; however, these trace amounts are often small enough to be disregarded.

One objective of this invention is to prepare a stainless uranium-steel alloy which has been cooled so rapidly that the iron and uranium atoms have not had a chance to segregate in two or more of the special crystalline forms called "phases" in metallurgical terminology. It is known in the art that the internal precipitation and formation of alpha-uranium can be avoided or mitigated by a technique known as "beta quenching", wherein the metal is heated above 668° C. to form the beta phase and then quenched through the alpha-beta transformation range too rapidly to allow growth of the new phase. This treatment produces a randomly oriented, fine-grain alpha-prime (martensitic alpha) phase. Taking advantage of this or similar phenomena, the preferred chromium content of an alloy of this invention will not be altered locally by the formation of the Cr-poor phase when cooling from the melt to solidification. The process of this invention as ordinarily practiced provides a very rapid cooling from temperatures at which the uranium-chromium or uranium-chromium-Group VIII metal mixture will be molten and generally homogeneous, and the degree of randomness or microscopic intermingling of the metallic elements in a flash-cooled or shot-tower cooled alloy can be at a very high level. Microscopic grains containing less than 10 or 12 atom-% chromium alloyed with uranium—which could microscopically corrode and become highly toxic—thus do not have sufficient time to form easily, so that the gross analysis of the alloy closely parallels the microscopic analysis. Furthermore, typical shot pellets are smaller than 10 mm in diameter and may even have diameters less than 1 mm. Accordingly, the surface of the generally spherical droplet of molten metal in the shot tower can generally be expected to be less than 5 mm from the innermost regions of the drop, thereby further insuring a rapid dissipation of the heat which was stored in the molten metal before it was formed into drops. Since typical drops falling down a shot tower form generally spherical shapes ranging from about 1 to about 5 mm in diameter, it can be assumed that the innermost regions of each drop will have cooled to a temperature near ordinary room temperature in a matter of seconds, most certainly less than 60 seconds. Shot towers designed to make spherical pellets out of stainless steel can also handle ferro-chromium-uranium alloys, since the melting point of these alloys will be considerably lower than that of most steels. Accordingly, the formation of the ferro-chromium-uranium pellets can proceed in the same manner as the formation of stainless steel pellets and, if anything, may occur even easier.

Not very much is known about chromium-uranium-Group VIII metal (e.g. Fe and/or Ni) systems, but the iron-uranium system has been discussed in the scientific literature, and at least two intermetallic compounds ($UFe_2$ and $U_6Fe$) have been reported. Very small amounts of uranium drastically depress the melting point of iron; similarly, small amounts of iron produce a drastic melting point depression at the other end of this binary system. The compound $UFe_2$ can be formed substantially free of the uncombined metals, and it reportedly melts at 1230° C. The compound $U_6Fe$ reportedly melts at only 805° C. Mixtures of $U_6Fe$ and $UFe_2$ (sometimes containing up to about 20% uranium oxides), generally free of uncombined metals, provide the lowest-melting species shown in the constitutional or phase diagram published by Grogan, the amazingly low melt temperature of 725° C. being possible with such a mixture having an overall iron content or gross analysis near 10 weight-% (32 atom-%). A mixture of $UFe_2$ and free iron can have a melting point as low as 1055° C., which is 70 Celsius degrees below that of pure uranium and about 480 degrees below that of pure iron.

In the context of this invention, the formation or presence of Fe-U intermetallic compounds is preferable to either Fe-Cr or U-Cr compounds, and any loss of cold-workability or the like resulting from the ferro-uranium compounds is not detrimental to the objectives of the invention. The formation of chromium compounds within the Fe-Cr-U system can be compensated for by further addition of chromium metal or mixtures containing chromium in the uncombined metallic state. In any event, uranium, both combined and uncombined, has a fluxing effect on an alloy used in this invention and can help to keep melt temperatures below 1500° C., more typically below 1450° C.

It is known that uranium alloys show better corrosion resistance than unalloyed uranium. Resistance to general corrosion increases with alloy content and appears to be inversely related to stress corrosion behavior. Fortunately, stress-corrosion resistance is not important in the context of this invention, thereby insuring the practicality of alloys containing any amount of uranium, however small, provided that this amount is sufficient to make an appreciable contribution to the density of the alloy. An alloy containing only 3 atom-% uranium and 10–18 atom-% chromium, the balance being essentially the less expensive Group VIII metals, could show a density improvement of 0.5 g/cm$^3$ or more.

As will be apparent from the foregoing discussion, this invention is not limited to the selection of an available stainless steel scrap or ferro-chromium master alloy for alloying with the uranium. Suitable ferro-chromium-uranium or chromium-uranium alloys can be formulated from the elements themselves or other alloys, intermetallic compounds or the like and specifically tailored to the objectives of this invention.

Very high density elements can be obtained without making the uranium fraction any larger than about 15 atom-% or about 40% by weight. At the 20 atom-% level, one can readily approach the density of lead, depending upon the iron and chromium content. At 25–35 atom-% uranium, the density of lead is easily exceeded with 12–20 atom-% chromium and the balance essentially iron. It is believed that toxicity hazards can best be controlled when the uranium content is a minor amount in terms of atomic percent; nevertheless, amounts up to 70 atom-% uranium leave enough room for a reasonably inexpensive ferro-chromium system with "stainless"-imparting characteristics. Because of the high atomic weight of uranium, such an alloy would contain an amazing 90% by weight of uranium. The equally amazingly low level of about 3.5 weight-% chromium would still provide the desired 12 atom-% and an ability to form microscopically thin, adherent metal oxides in air. In a typical ferro-chromium-uranium system, other elements need not exceed, in total, more than 5 or 10 atomic percent and thus iron will typically be the major constituent of any component other than the uranium or chromium component.

Stated another way, the broadly acceptable and preferred atomic percentage fractions of the ferro-chromium-uranium alloy are as follows.

| | Atomic Percent (Atom-%) | |
|---|---|---|
| Element | Broad | Preferred |
| U | 3.0–70 | 15–35 |
| Fe | 1–87 | 50–73 |
| Cr | 10–35 | 12–20 |
| Other elements | 0–10 | 0–5 |

As noted previously, partial replacement of the preferred chromium fraction with another corrosion resistance-enhancing element can help to provide the desired passivity at the 10 atom-% level of chromium.

It should be assumed that the uranium in the foregoing table is totally or predominantly the $U^{238}$ isotope, an economically viable form of this isotope being the so-called depleted uranium. By using the 238 isotope, radiation is kept to tolerable levels and the economics of the invention remain within reach of practicality.

As is known in the art, all of these preferred metals can form oxides in the presence of air, and uranium is a particularly rapid oxide-former. For this and other reasons, it may be desirable to utilize a shot tower containing a nonoxidizing atmosphere such as a noble gas or nitrogen. (Although nitrogen can combine with metals at elevated temperatures, and this is sometimes intentionally done in stainless steel technology, nitrogen is an optional element in this invention.)

In the claims which follow, amounts (e.g. in atom-%) of uranium and any other elements should be understood to be gross amounts, in which both free and combined forms are included. In the case of chromium, the recited amounts should be understood to refer to corrosion-resistance or "stainless"-imparting forms of the metal, e.g. free (uncombined) chromium and ferrochromium.

CROSS REFERENCE TO RELATED APPLICATION

This application includes subject matter disclosed in U.S. Patent Application Ser. No. 7,222 filed Jan. 29, 1979 now abandoned.

What is claimed is:

1. A solid, generally spherical, generally corrosion-resistant, iron-chromium-uranium metal pellet consisting essentially of a generally corrosion-resistant iron-chromium-uranium alloy which has been cooled from the molten state to below its solidification temperature quickly enough to prevent the formation of any segregated uranium-rich phase containing less than 10 atomic percent chromium, thereby forming a fine-grain alloy structure, said iron-chromium-uranium alloy having a specific gravity of at least about 8.4 and consisting essentially of about 3 to about 35 atomic-% uranium, about 10 to 35 atomic-% chromium the major amount of the alloy, by atomic-%, being iron, the uranium of said iron-chromium-uranium containing more than 99.3% of the $U^{238}$ isotope.

2. A pellet according to claim 1 wherein the iron-chromium-uranium alloy contains an amount of chromium sufficient to make said alloy resistant to corrosion in moisture-containing environments at normal ambient outdoor temperatures.

3. A pellet according to claim 1 wherein the amount of chromium is at least about 12 atomic percent.

4. A pellet according to claim 1 consisting essentially of an iron-chromium-uranium alloy in which the iron content is less than 87 atomic-%, said iron-chromium-uranium alloy having been cooled from the molten state to a temperature approaching ambient in less than about one minute.

5. A solid, generally spherical metal shotgun pellet consisting essentially of a solid iron-chromium-uranium alloy having a specific gravity of at least about 8.4, said pellet having been formed by cooling to ambient temperature, in less than about a minute, a molten solution comprising a uranium isotope mixture in molten stainless steel, said isotope mixture containing more than 99.3% $U^{238}$; said solid alloy consisting essentially of about 3 to about 35 atomic % solid uranium, having essentially the isotopic distribution in said molten solution, about 50–87 atomic-% iron, and about 10–35 atomic-% chromium.

6. A pellet according to claim 5 wherein said uranium isotope mixture contains less than 0.3% $U^{235}$.

7. In a process for making high density ammunition from uranium containing at least the naturally-occurring amount of the $U^{238}$ isotope, the steps comprising:

(a) blending together, as elements or intermetallic compounds, the elements consisting essentially of about 3 to about 35 atomic % uranium, about 10–35 atomic % molten chromium, and about 50–87 atomic-% iron, in the molten state, thereby obtaining essentially a solution, (b) cooling the resulting solution to about ambient temperature quickly enough to prevent the formation of a segregated uranium-rich phase containing less than 10 atomic % free chromium, thereby obtaining a solid metal pellet having a fine grain structure and a specific gravity of at least about 8.4.

8. A method according to claim 7 wherein the blend produced according to said step (a) is formed into molten drops which are exposed to normal ambient temperatures, thereby cooling the drops to solid, generally spheroidal pellets in less than about one minute.

9. A method according to claim 7 wherein at least part of the chromium and at least part of the iron are added as an iron-chromium alloy or mixture.

10. A method according to claim 9 wherein the iron-chromium mixture or alloy is (a) ferro-chromium obtained from reduced chromium oxide-containing ore, (b) scrap stainless steel, or (c) mixtures of (a) or (b) with a metal of Group VIII, first triad, of the Periodic Table.

11. An iron-chromium-uranium alloy having stainless properties and a specific gravity of at least about 8.4, said alloy consisting essentially of a fine-grain structure consisting essentially of:

3–35 atomic-% uranium, which uranium has at least the naturally-occurring amount of the $U^{238}$ isotope,
50–87 atomic-% iron, and
10–35 atomic-% chromium, said alloy being substantially free of solid segregated phases locally containing less than 10 atomic-% free chromium.

12. An iron-chromium-uranium alloy according to claim 11 consisting essentially of:

15–35 atomic-% uranium
50–73 atomic-% iron, and
12–20 atomic-% chromium, said alloy having a melting point below the melting point of iron.

13. An iron-chromium-uranium alloy according to claim 11 containing 0–5 atomic-% of a combination of other metals or nonmetals typically found in stainless steel, said metals or nonmetals being selected from silicon; a Group VIII element, other than iron; carbon; manganese; molybdenum; aluminum; copper; vanadium; wolfram; zirconium; boron; tantalum; or niobium; and further containing up to trace amounts of nitrogen, selenium, phosphorus, hydrogen or oxygen.

14. A shotgun pellet according to claim 5 wherein said pellet is about 1–10 mm in diameter and said alloy consists essentially of a fine-grain structure consisting essentially of:

15–35 atomic-% uranium,
50–73 atomic-% iron, and
12–20 atomic-% chromium.

15. An iron-chromium-uranium alloy according to claim 11 containing 12–20 atomic-percent chromium.

* * * * *